US008344661B2

(12) United States Patent
Hsu et al.

(10) Patent No.: US 8,344,661 B2
(45) Date of Patent: Jan. 1, 2013

(54) LED DEVICE WITH SIMULTANEOUS OPEN AND SHORT DETECTION FUNCTION AND METHOD THEREOF

(75) Inventors: Kuo-Ching Hsu, Hsinchu (TW); Chin-Hsun Hsu, Taipei County (TW); Tsung-Hau Chang, Hsinchu (TW); Ting-Wei Liao, Taipei County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 435 days.

(21) Appl. No.: 12/647,381

(22) Filed: Dec. 24, 2009

(65) Prior Publication Data

US 2011/0043114 A1 Feb. 24, 2011

(30) Foreign Application Priority Data

Aug. 19, 2009 (TW) ..... 98127838 A

(51) Int. Cl.
*H05B 37/02* (2006.01)

(52) U.S. Cl. ..... 315/307; 315/291; 315/308

(58) Field of Classification Search ..... 315/185 R, 315/192, 291, 294, 297, 299, 301, 307, 308, 315/312, 361
See application file for complete search history.

(56) References Cited

U.S. PATENT DOCUMENTS

2004/0080273 A1* 4/2004 Ito et al. ..... 315/77
2005/0269968 A1* 12/2005 Ito et al. ..... 315/282
2007/0085494 A1* 4/2007 Takeda et al. ..... 315/316

FOREIGN PATENT DOCUMENTS

CN 101207958 A 6/2008

* cited by examiner

*Primary Examiner* — Douglas W Owens
*Assistant Examiner* — Jianzi Chen
(74) *Attorney, Agent, or Firm* — Winston Hsu; Scott Margo

(57) ABSTRACT

An LED device with simultaneous open and short detection function includes a plurality of LED strings, a voltage converter, a current driving unit, a loop control unit, an open detector, a short detector and a voltage detector. The open detector and the short detector are utilized for detecting LED open and LED short for the plurality of LED strings, respectively. The voltage detector is coupled to the open detector, the short detector and the voltage converter, and is utilized for generating a reset signal to the short detector according to an output voltage of the voltage converter when the LED open occurs on the plurality of LED strings, so as to initiate the LED short detection for the plurality of LED strings again.

13 Claims, 7 Drawing Sheets

LED DEVICE WITH SIMULTANEOUS OPEN AND SHORT DETECTION FUNCTION AND METHOD THEREOF

BACKGROUND OF THE INVENTION

1. Field of the Invention

The present invention relates to an LED device and related method, and more particularly, to an LED device with a simultaneous open and short detection function and related method.

2. Description of the Prior Art

Light emitting diodes (LEDs) used as light sources has become popular in recent years. For example, cold cathode fluorescent lamps (CCFLs) are conventionally used as a light source in a backlight module of a liquid crystal display. However, LEDs have gradually replaced CCFLs as the light source of the backlight module due to continuously rising luminous efficiency and decreasing cost.

In an LED driving circuit of the prior art, if LED open occurs on an LED string, since a corresponding output channel of the LED driving circuit is floating, the LED driving circuit would have electric leakage, which deteriorates conversion efficiency of the circuit or results in abnormal operation of a voltage conversion loop. Besides, if LED short occurs on an LED string, i.e. cross voltages of some LEDs are zero, headroom voltages of current driving elements would be raised correspondingly, which results in higher power consumption of the current driving elements and deteriorates the conversion efficiency of the circuit as well. Therefore, the LED driving circuit should have LED open and LED short detection mechanism.

Please refer to FIG. 1. FIG. 1 is a schematic diagram of an LED driving circuit 10 according to the prior art. The LED driving circuit 10 is utilized for driving an LED module 11. As shown in FIG. 1, the LED module 11 includes parallel-connected LED strings C1~Cm, and each LED string further includes a plurality of series-connected LEDs. The LED driving circuit 10 includes a voltage converter 12, a current driving unit 13 and a loop control unit 14. The voltage converter 12 is utilized for converting an input voltage V1 to an output voltage V2 according to a voltage control signal VCTRL so as to drive the LED module 11. The current driving unit 13 is utilized for sinking fixed driving currents Id1~Idm from the LED module 11. The loop control unit 14 controls voltage conversion of the voltage converter 12 according to voltage differences between negative electrode voltages VHR1~VHRm of the LED strings C1~Cm and a default reference voltage VREF, for stabilizing a voltage level of the output voltage V2.

Moreover, the loop control unit 14 further includes a voltage selector 142, an error amplifier 144 and a conversion controller 146. The voltage selector 142 is coupled to the LED strings C1~Cm, and is utilized for selecting a lowest voltage of the negative electrode voltages VHR1~VHRm as a feedback voltage VFB. The error amplifier 144 is coupled to the voltage selector 142 and the reference voltage VREF, and is utilized for generating an error voltage signal VERR according to voltage difference between the feedback voltage VFB and the reference voltage VREF. The conversion controller 146 is coupled to the error amplifier 144 and the voltage converter 12, and is utilized for generating a voltage control signal VCTRL according to the error voltage signal VERR.

Therefore, through the loop control unit 14, the LED driving circuit 10 can lock the negative electrode voltages VHR1~VHRm of the LED strings C1~Cm, i.e. the headroom voltages of the current driving elements, and the output voltage V2 of the voltage converter 12 within a sensible range.

In this case, the LED driving circuit 10 further includes an open detector 15 and a short detector 16, which are utilized for performing LED open detection and LED short detection on the LED strings C1~Cm, respectively. Since the headroom voltages of the current driving elements would be pulled to a low voltage level when the LED strings C1~Cm have LED open, the open detector 15 can thus determine the LED open occurring on the LED strings C1~Cm according to whether the negative electrode voltages VHR1~VHRm of the LED strings C1~Cm are lower than a certain low threshold voltage. Of course, the said low threshold voltage cannot be set higher than the headroom voltages of the current driving elements under normal operation for preventing from false LED open detection during the normal operation situations. On the contrary, when the LED strings C1~Cm have LED short, i.e. cross voltages of some LEDs are zero, the headroom voltages of the current driving elements would rise correspondingly. Thus, the short detector 16 can determine the LED short occurring on the LED strings C1~Cm according to whether the negative electrode voltages VHR1~VHRm of the LED strings C1~Cm are higher than a certain high threshold voltage. Similarly, the said high threshold voltage cannot be set lower than the headroom voltages of the current driving elements under the normal operation for preventing from false short detection during the normal operation situations.

However, the LED driving circuit 10 may erroneously determine the LED short occurring on the LED strings C1~Cm when simultaneously performing the LED open and short detection on the LED strings C1~Cm. For example, when the LED string C1 has the LED open, the headroom voltage of the current driving element is pulled to a low voltage level (ex. a ground voltage). Thus, the voltage selector 142 would select the negative electrode voltage VHR1 of the LED string C1 as the feedback voltage VFB, such that the output voltage V2 of the voltage converter 12 is raised. Under this situation, since the cross voltages of the LEDs are fixed, the negative electrode voltages VHR2~VHRm of the LED strings C2~Cm would follow the output voltage V2 to rise above the said certain high threshold voltage, which results in false determination of the short detector 16.

In other words, when the LED open and the LED short detection are simultaneously performed on the LED strings, the prior art may have false LED short detection immediately after the LED open is detected on some of the LED strings.

SUMMARY OF THE INVENTION

It is therefore an objective of the present invention to provide an LED device with a simultaneous open and short detection function and related method.

The present invention discloses an LED device with a simultaneous open and short detection function. The LED device includes a plurality of LED strings, a voltage converter, a current driving unit, a loop control unit, an open detector, a short detector and a voltage detector. Each LED string of the plurality of LED strings has a positive electrode and a negative electrode. The voltage converter is coupled to the positive electrodes of the plurality of LED strings, and is utilized for converting a first voltage to a second voltage according to a voltage control signal. The current driving unit is coupled to the negative electrodes of the plurality of LED strings, and is utilized for providing a plurality of driving currents to the plurality of LED strings. The loop control unit is coupled to the plurality of LED strings and the voltage converter, and is utilized for generating the voltage control signal according to the negative electrode voltages of the plurality of LED strings. The open detector is coupled to the plurality of LED strings and the loop control unit, and is utilized for performing LED open detection on the plurality of LED strings according to the negative electrode voltages of the plurality of LED strings. The short detector is coupled to the plurality of LED strings and the loop control unit, and is utilized for performing LED short detection on the plurality of LED strings according to the negative electrode voltages of the plurality of LED strings. The voltage detector is coupled to the open detector, the short detector and the voltage converter, and is utilized for generating a reset signal to the short detector for restarting the LED short detection on the plurality of LED strings according to level variation of the second voltage when the open detector detects LED open on the plurality of LED strings.

The present invention also discloses a method of simultaneously detecting open and short for an LED device. The LED device includes a plurality of LED strings and a voltage converter. Each LED string of the plurality of LED strings has a positive electrode and a negative electrode. The voltage converter is coupled to the positive electrodes of the plurality of LED strings, and is utilized for converting a first voltage to a second voltage. The method includes performing LED open and LED short detection on the plurality of LED strings according to negative electrode voltages of the plurality of LED strings; and restarting the LED short detection on the plurality of LED strings according to level variation of the second voltage when the open detector detects LED open on the plurality of LED strings.

The present invention also discloses an LED device with a simultaneous open and short detection function. The LED device includes a plurality of LED strings, a voltage converter, a current driving unit, a loop control unit and an open and short detector. Each LED string of the plurality of LED strings has a positive electrode and a negative electrode. The voltage converter is coupled to the positive electrodes of the plurality of LED strings, and is utilized for converting a first voltage to a second voltage. The current driving unit is coupled to the negative electrodes of the plurality of LED strings, and is utilized for providing a plurality of driving currents to the plurality of LED strings. The loop control unit is coupled to the plurality of LED strings and the voltage converter, and is utilized for generating the voltage control signal according to negative electrode voltages of the plurality of LED strings. The open and short detector is coupled to the plurality of LED strings, the loop control unit and the voltage converter, and is utilized for performing LED open and LED short detection on the plurality of LED strings according to the negative electrode voltages of the plurality of LED strings and a level variation trend of the second voltage.

The present invention also discloses a method of simultaneously detecting open and short for an LED device. The LED device includes a plurality of LED strings and a voltage converter. Each LED string of the plurality of LED strings has a positive electrode and a negative electrode. The voltage converter is coupled to the positive electrode of the plurality of LED strings, and is utilized for converting a first voltage to a second voltage according to a voltage control signal. The method includes generating the voltage control signal according to the negative electrode voltages of the plurality of LED strings; and performing LED open and LED short detection on the plurality of LED strings according to the negative electrode voltages of the plurality of LED strings and a level variation trend of the second voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
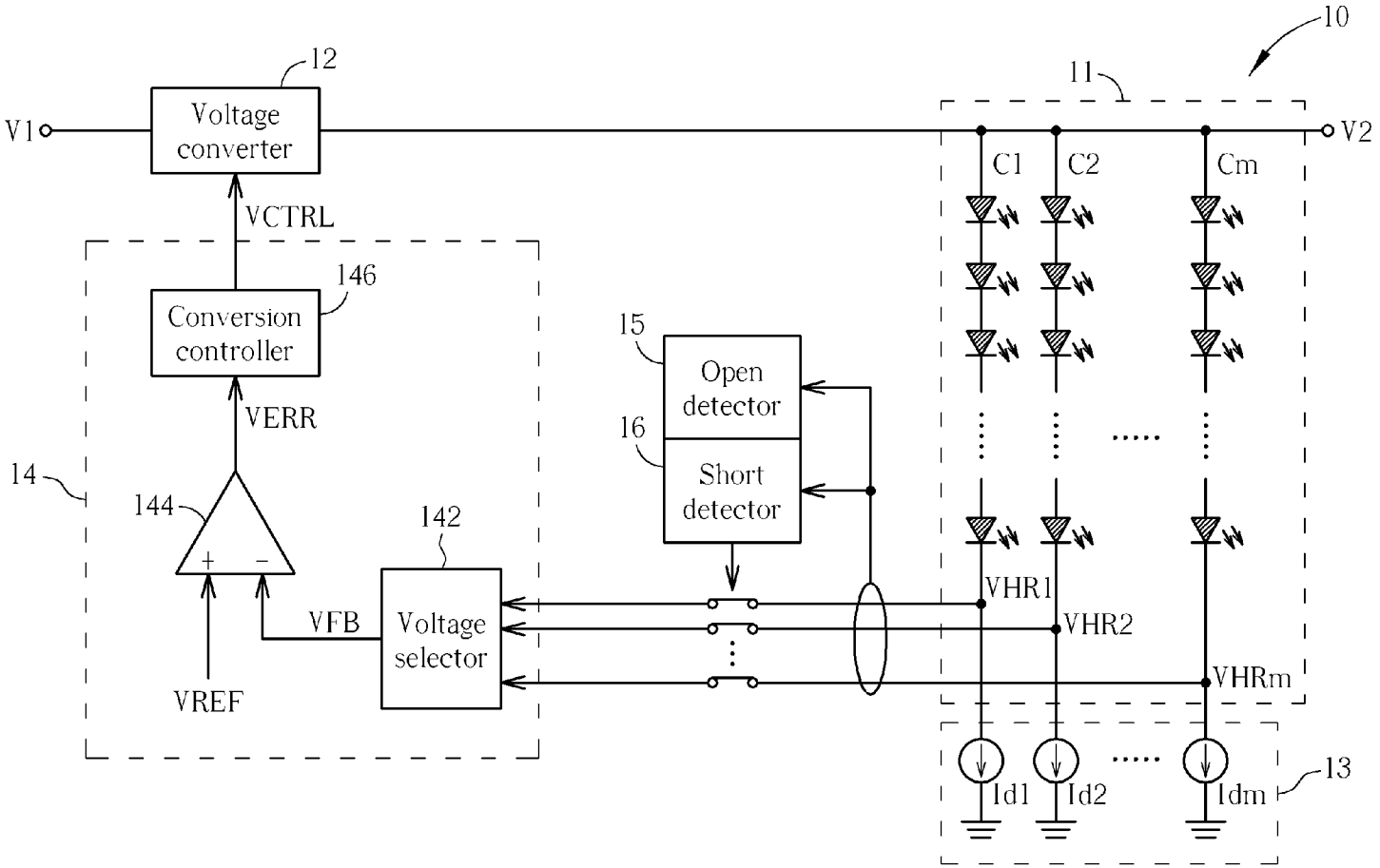
FIG. 1 PRIOR ART
FIG. 1 is a schematic diagram of an LED driving circuit according to the prior art.
Figure 2:
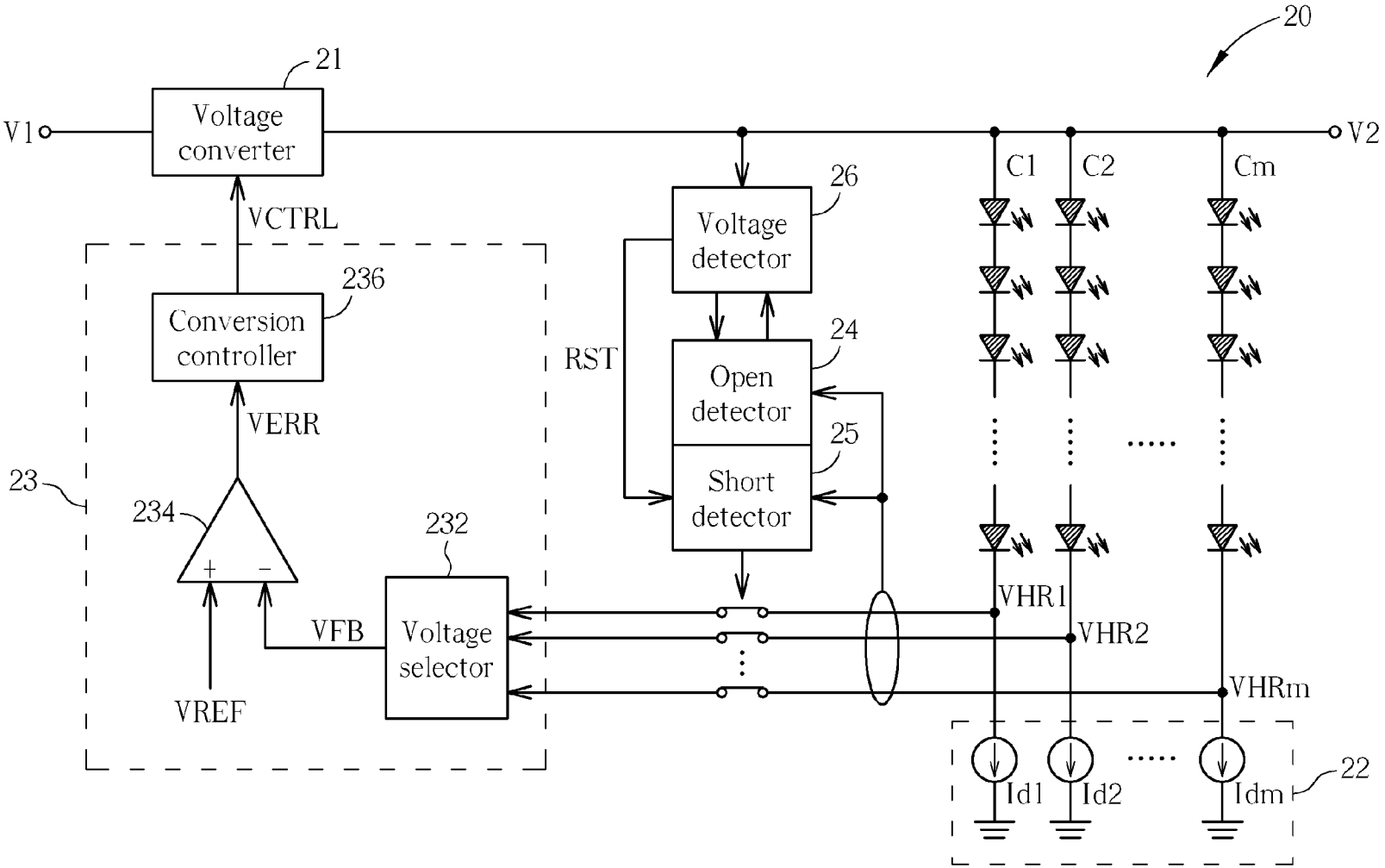
FIG. 2 is a schematic diagram of an LED device with a simultaneous open and short detection function according to a first embodiment of the present invention.

Please refer to FIG. 2. FIG. 2 is a schematic diagram of an LED device 20 with a simultaneous open and short detection function according to a first embodiment of the present invention. The LED device 20 includes parallel-connected LED strings C1~Cm, a voltage converter 21, a current driving unit 22, a loop control unit 23, an open detector 24, a short detector 25 and a voltage detector 26. The voltage converter 21 is coupled to positive electrodes of the LED strings C1~Cm, and is utilized for converting a first voltage V1 to a second voltage V2 according to a voltage control signal VCTRL and outputting the second voltage V2 as a stable driving voltage of the LED strings C1~Cm. The current driving unit 22 is coupled to negative electrodes of the LED strings C1~Cm, and is utilized for providing fixed driving currents Id1~Idm to the LED strings C1~Cm. The loop control unit 23 is coupled to the LED strings C1~Cm and the voltage converter 21, and is utilized for generating the voltage control signal VCTRL according to negative electrode voltages VHR1~VHRm of the LED strings C1~Cm. The open detector 24 is coupled to the LED strings C1~Cm and the loop control unit 23, and is utilized for performing LED open detection on the LED strings C1~Cm according to the negative electrode voltages VHR1~VHRm of the LED strings C1~Cm. The short detector 25 is coupled to the LED strings C1~Cm and the loop control unit 23, and is utilized for performing short detection on the LED strings C1~Cm according to the negative electrode voltages VHR1~VHRm of the LED strings C1~Cm. The voltage detector 26 is coupled to the open detector 24, the short detector 25 and the voltage converter 26, and is utilized for generating a reset signal RST to the short detector 25 for restarting the LED short detection on the LED strings C1~Cm according to level variation of the second voltage V2 when the open detector 24 detects LED open occurring on the LED strings C1~Cm.

Therefore, when the LED device 20 simultaneously performs the LED open and LED short detection on the LED strings C1~Cm, if the LED open is detected occurring on the LED strings C1~Cm, the embodiment of the present invention generates and sends the reset signal RST to the short detector 25 according to the level variation of the second voltage V2, so as to restart the LED short detection on the LED strings C1~Cm. Accordingly, the embodiment of the present invention can avoid false LED short detection that happens immediately after occurrence of the LED open is detected.

Preferably, the loop control unit 23 further includes a voltage selector 232, an error amplifier 234 and a conversion controller 236. The voltage selector 232 is coupled to the LED strings C1~Cm, and is utilized for selecting a lowest voltage of the negative electrode voltages VHR1~VHRm of the LED strings C1~Cm as a feedback voltage VFB. The error amplifier 234 is coupled to the voltage selector 232 and a reference voltage VREF, and is utilized for generating an error voltage signal VERR according to voltage difference between the feedback voltage VFB and the reference voltage VREF. The conversion controller 236 is coupled to the error amplifier 234 and the voltage converter 21, and is utilized for generating the voltage control signal VCTRL according to the error voltage signal VERR, to control conversion operation of the voltage converter 21. As for detailed operation of the LED device 20, please refer to the following description.

Figure 3:
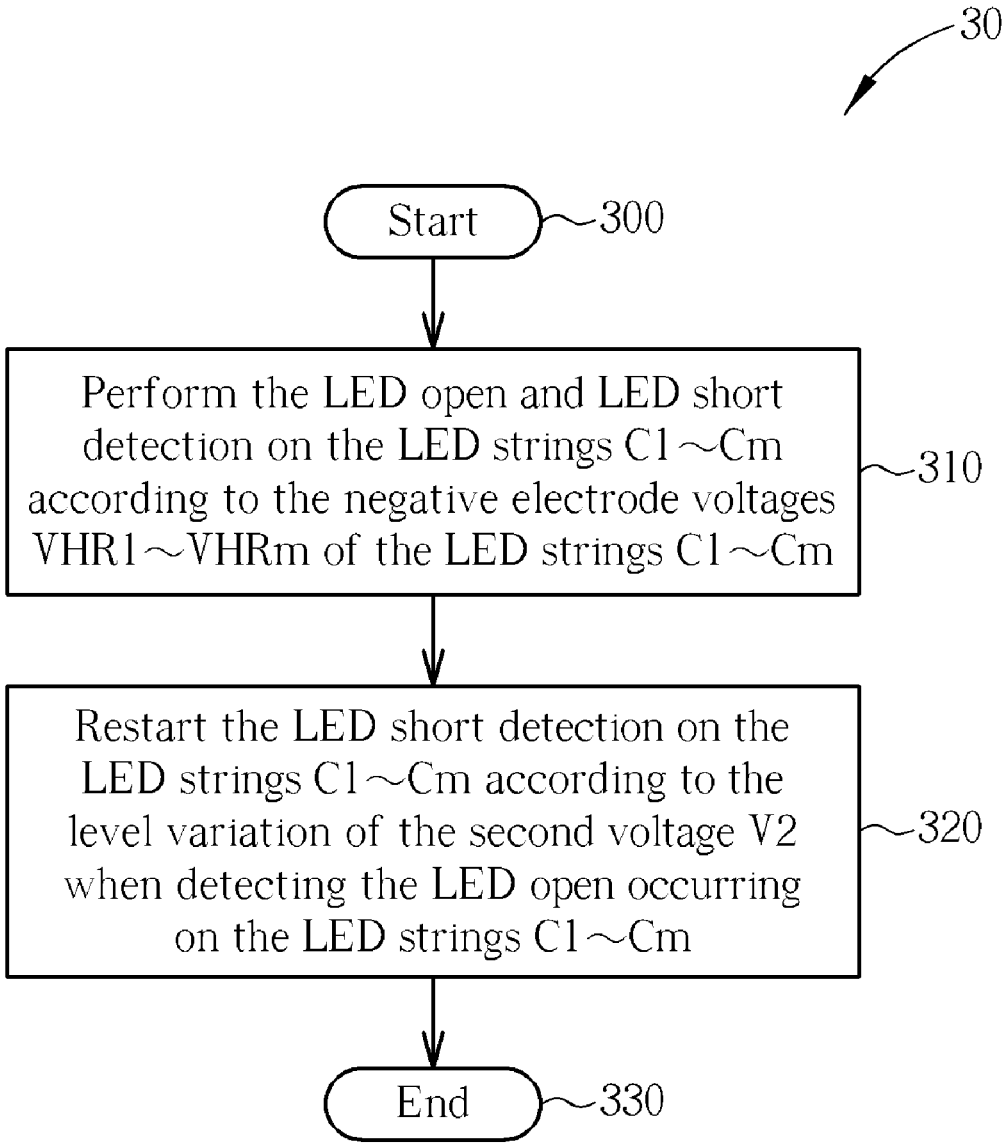
FIG. 3 is a schematic diagram of a process for an LED device simultaneously detecting LED open and short according to an embodiment of the present invention.

Please refer to FIG. 3, which is a schematic diagram of a process 30 for the LED device 20 simultaneously detecting LED open and short according to an embodiment of the present invention. The process 30 is utilized for realizing an operation process of the LED device 20, and includes the following steps:

Step 300: Start.

Step 310: Perform the LED open and LED short detection on the LED strings C1~Cm according to the negative electrode voltages VHR1~VHRm of the LED strings C1~Cm.

Step 320: Restart the LED short detection on the LED strings C1~Cm according to the level variation of the second voltage V2 when detecting the LED open occurring on the LED strings C1~Cm.

Step 330: End.

According to the process 30, the LED open and LED short detection is firstly performed on the LED strings C1~Cm according to the negative electrode voltages VHR1~VHRm of the LED strings C1~Cm. When the LED strings C1~Cm are detected to have the LED open, the LED short detection of the LED strings C1~Cm is restarted according to the level variation of the second voltage V2, for preventing the LED short detection from being erroneously determined after the LED open occurs on the LED strings.

As stated in the prior art, when the LED open occurs on the LED strings C1~Cm, the negative electrode voltages VHR1~VHRm of the LED strings C1~Cm, i.e. the headroom voltages of the current driving elements, would be pulled to a low voltage level such as a ground voltage level, for example. Thus, the open detector 24 can determine the LED open occurring on the LED strings C1~Cm according to whether the negative electrode voltages VHR1~VHRm of the LED strings C1~Cm are lower than a first threshold voltage. On the contrary, when the LED short occurs on the LED stings C1~Cm, the negative electrode voltages VHR1~VHRm of the LED strings C1~Cm would be raised correspondingly. Thus, the short detector 25 can determine the LED short occurring on the LED strings C1~Cm according to whether the negative electrode voltages VHR1~VHRm of the LED strings C1~Cm are higher than a second threshold voltage. Of course, the said first threshold voltage cannot be set higher than the headroom voltages of the current driving elements under normal operation, and the second threshold voltage cannot be set lower than the headroom voltages of the current driving elements under the normal operation, so as to prevent from false detection during the normal operation situations.

Besides, since the voltage selector 232 selects the negative electrode voltage of which the LED string has the LED open as the feedback voltage VFB, the output voltage V2 of the voltage converter 21 would be raised. Therefore, the voltage detector 26 can detect whether the voltage level of the output voltage V2 is higher than a third threshold value to generate the reset signal RST, so as to restart the LED short detection on the LED strings.

Figure 4:
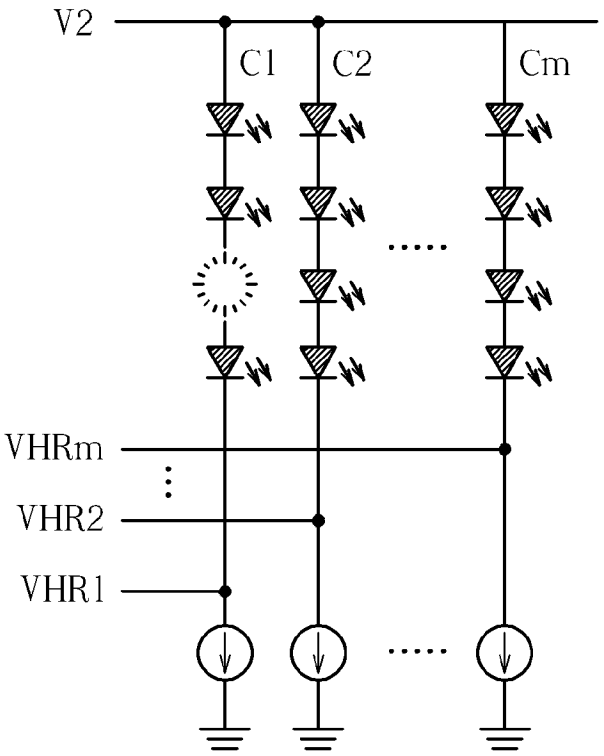
FIG. 4 illustrates a situation where LED short detection is restarted when LED open occurs on an LED string according to an embodiment of the present invention.
Figure 4:
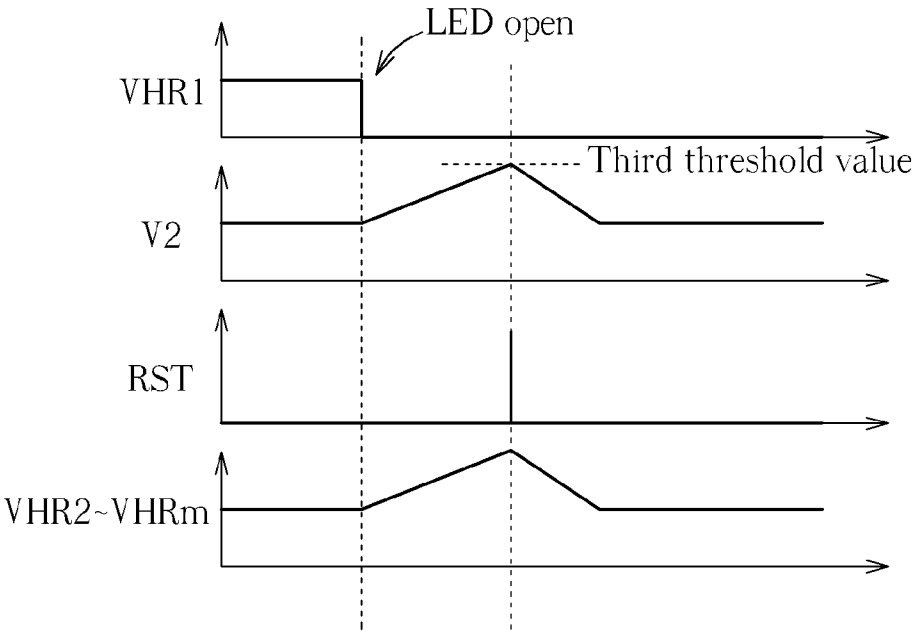

For example, please refer to FIG. 4, which illustrates a situation where the LED short detection is restarted when the LED open occurs on the LED string C1 according to an embodiment of the present invention. As shown in FIG. 4, when the LED open occurs on the LED string C1, the negative voltage VHR1 would be pulled to a low voltage level, ex. a ground voltage. Thus, the voltage selector 232 selects the negative electrode voltage VHR1 as the feedback voltage VFB, such that the output voltage V2 of the voltage converter 21 is raised. When the output voltage V2 is higher than the third threshold value, the voltage detector 26 immediately generates the reset signal RST to restart the LED short detection on the LED strings C1~Cm. Meanwhile, the loop control unit 23 performs over voltage protection on the output voltage V2 to maintain the output voltage V2 within a sensible voltage range.

Certainly, the process 30 can further include the following steps: cutting off electrical connection between the loop control unit 23 and the LED string having the LED open when the LED open is detected on the LED strings C1~Cm; and cutting off electrical connection between the current driving unit 22 and the LED string having the LED short when the LED short is detected on the LED strings C1~Cm. The above operation is well-known to those skilled in the art, and thus is not narrated herein.

In summary, when the LED open and short detection are simultaneously performed on the LED strings, the embodiment of the present invention restarts the LED short detection for the LED strings C1~Cm according to the voltage variation of the output voltage V2 immediately after the LED open is detected on the LED strings, so as to prevent the LED short detection from being erroneously determined. Accordingly, the incapability of simultaneously performing the LED open and LED short detection in the prior art can be improved.

Figure 5:
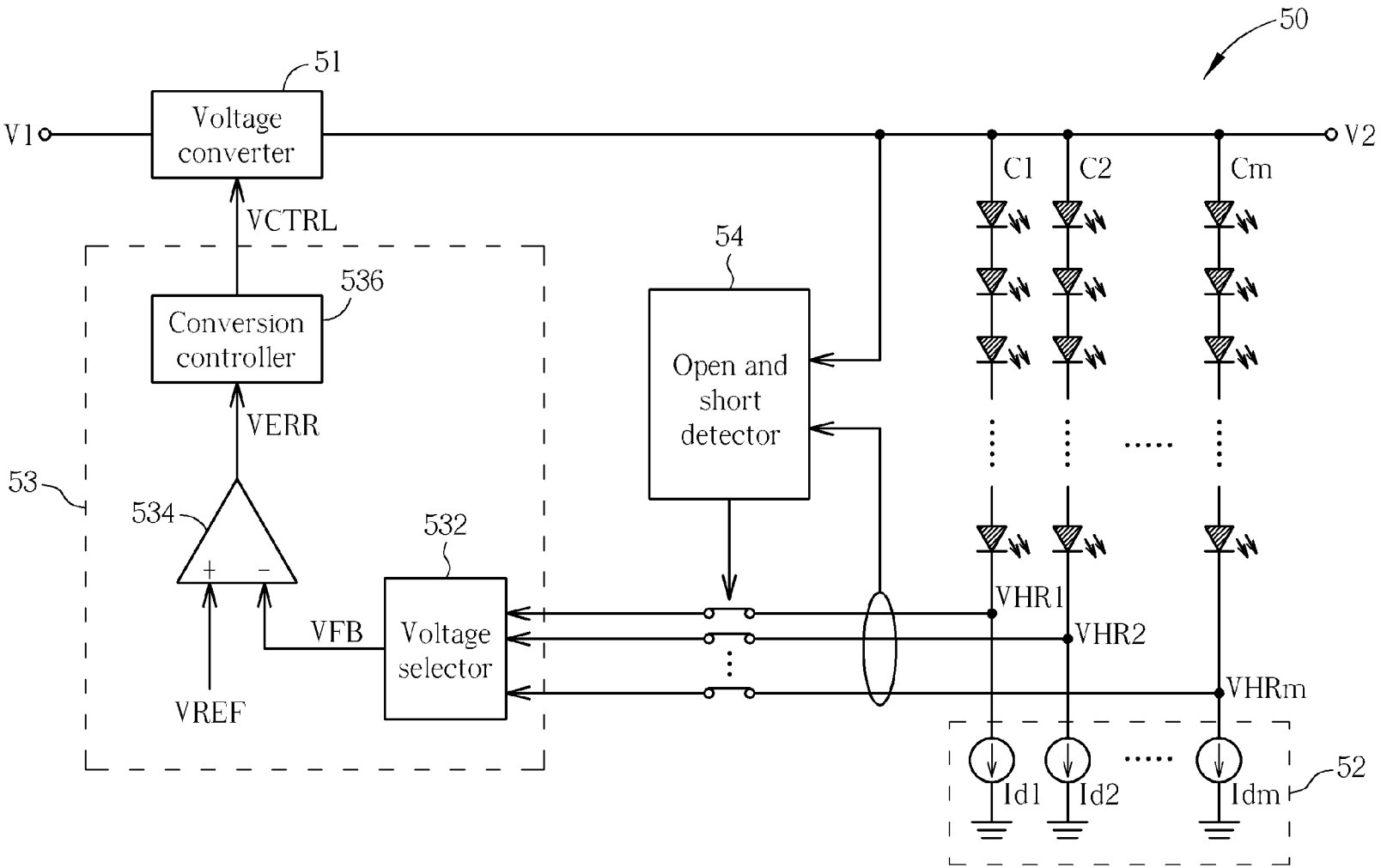
FIG. 5 is a schematic diagram of an LED device with a simultaneous open and short detection function according to a second embodiment of the present invention.

Please refer to FIG. 5. FIG. 5 is a schematic diagram of an LED device 50 with a simultaneous open and short detection function according to a second embodiment of the present invention. The LED device 50 includes parallel-connected LED strings C1~Cm, a voltage converter 51, a current driving unit 52, a loop control unit 53 and an open and short detector 54. The voltage converter 51, the current driving unit 52 and the loop control unit 53 are similar to the voltage converter 21, the current driving unit 22 and the loop control unit 23 in FIG. 2, and are not narrated again herein. The open and short detector 54 is coupled to the LED strings C1~Cm, the loop control unit 53 and the voltage converter 54, and is utilized for performing LED open and LED short detection on the LED strings C1~Cm according to level variation trends of both the negative electrode voltages VHR1~VHRm of the LED strings C1~Cm and the second voltage V2.

Since the cross voltages of the LEDs are fixed, the negative electrode voltages VHR1~VHRm of the LED strings C1~Cm and the output voltage V2 of the voltage converter 51 would have the same level variation trends under normal operation, i.e. no LED string has LED open or LED short. In this case, when the level variation trends of the negative electrode voltages VHR1~VHRm of the LED strings C1~Cm and the second voltage V2 are different, the embodiment of the present invention can detect the LED open or the LED short on the LED strings C1~Cm accordingly. As a result, the incapability of simultaneously performing the LED open and short detection on the LED strings can also be improved. As for detailed operation of the LED device 50, please refer to the following description.

Figure 6:
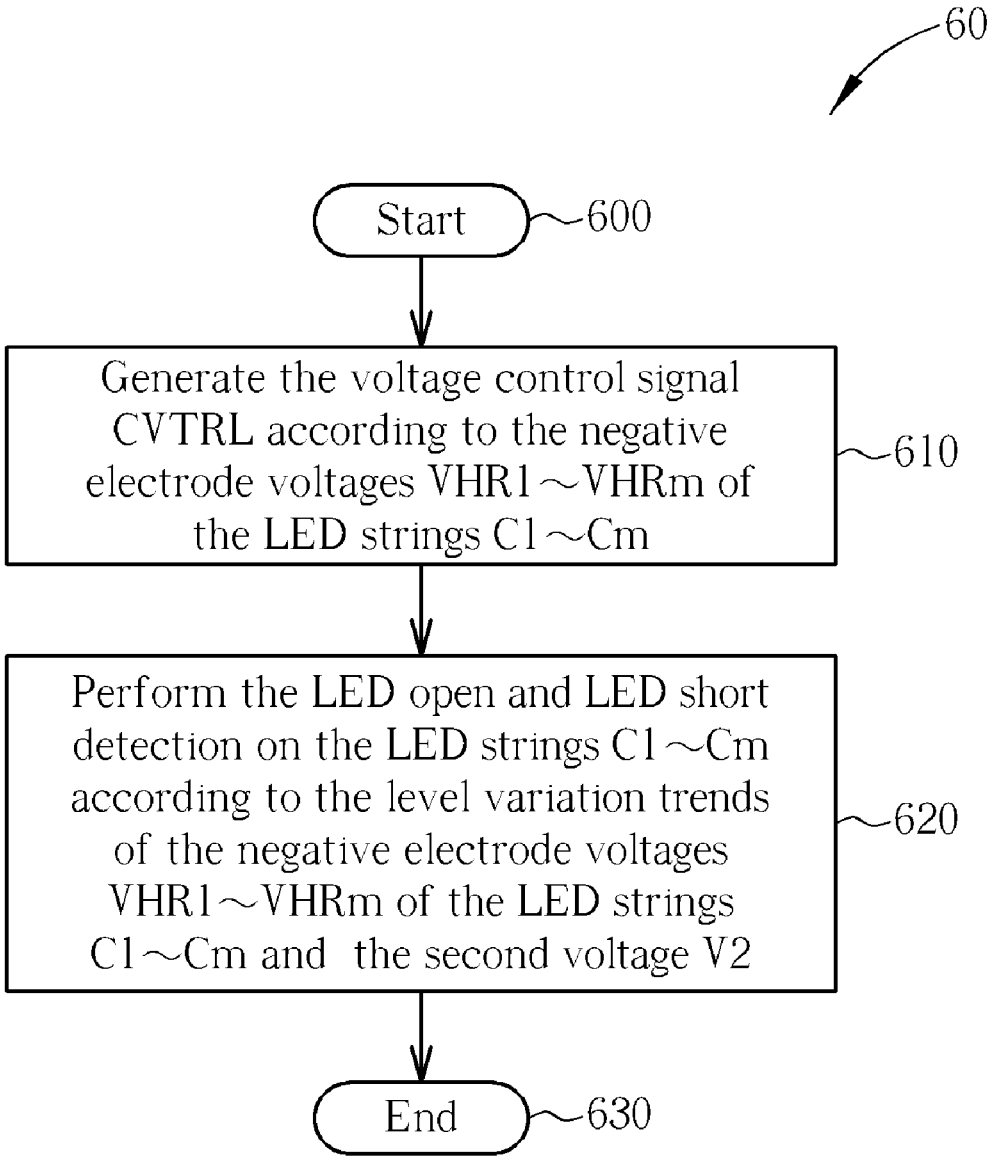
FIG. 6 is a schematic diagram of a process for an LED device simultaneously performing LED open and short detection according to an embodiment of the present invention.

Please refer to FIG. 6. FIG. 6 is a schematic diagram of a process 60 for the LED device 50 simultaneously performing LED open and short detection according to an embodiment of the present invention. The process 60 is utilized for realizing an operation process of the LED device 50, and includes the following steps:

Step 600: Start.

Step 610: Generate the voltage control signal CVTRL according to the negative electrode voltages VHR1~VHRm of the LED strings C1~Cm.

Step 620: Perform the LED open and LED short detection on the LED strings C1~Cm according to the level variation trends of the negative electrode voltages VHR1~VHRm of the LED strings C1~Cm and the second voltage V2.

Step 630: End.

According to the process 60, the voltage control signal CVTRL is generated according to the negative electrode voltages VHR1~VHRm of the LED strings C1~Cm. Then, the LED open and LED short detection can be performed on the LED strings C1~Cm according to the level variation trends of the negative electrode voltages VHR1~VHRm of the LED strings C1~Cm and the second voltage V2.

Figure 7:
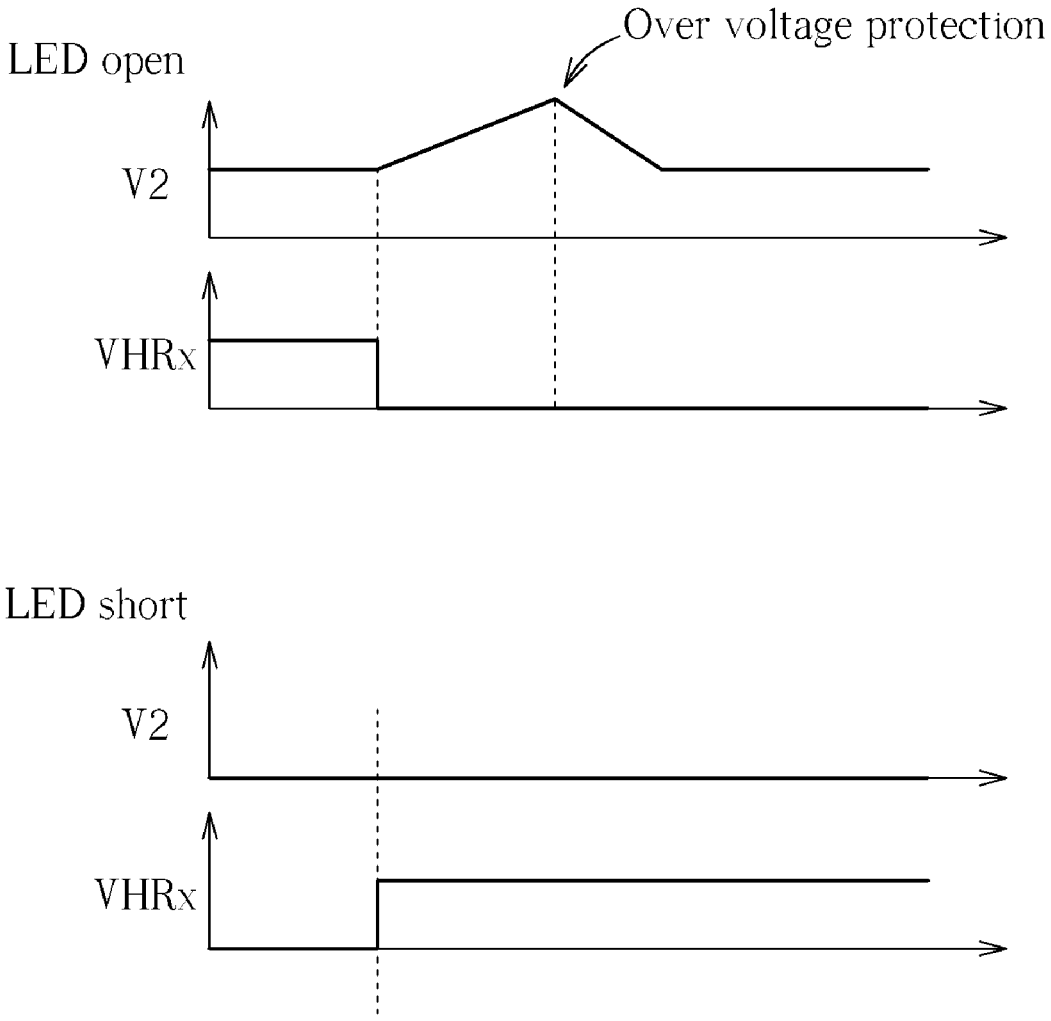
FIG. 7 illustrates level variation trends of a negative electrode voltage of an LED string and an output voltage of a voltage converter when the LED string has LED open or LED short.

In other words, after the voltage conversion loop is established, the LED open and LED short detection can be performed on the LED strings C1~Cm by detecting whether the voltage variation trends of the negative electrode voltages VHR1~VHRm and the second voltage V2 are the same. For example, please refer to FIG. 7, which illustrates the level variation trends of the negative electrode voltage VHRx of the LED string Cx and the output voltage V2 of the voltage converter 51 when the LED string Cx has LED open or LED short. As mentioned above, when the LED open occurs on the LED string Cx, the negative electrode voltage VHRx of the LED string Cx would be pulled to a low voltage level such as a ground voltage level, for example. Thus, the voltage selector 532 would select the negative electrode voltage VHRx as the feedback voltage VFB, so as to raise the output voltage V2 of the voltage converter 51. On the contrary, when the LED short occurs on the LED string Cx, i.e. the cross voltages of some LEDs in the LED string Cx are zero, the negative electrode voltage VHRx would then be raised correspondingly.

Therefore, when detecting the negative electrode voltage VHRx of the LED string Cx descending and the level of the second voltage V2 rising, the LED open and LED short detector 54 determines that the LED open occurs on the LED string Cx. On the contrary, when detecting the negative electrode voltage VHRx of the LED string Cx rising and the level of the second voltage V2 unchanged, the LED open and LED short detector determines that the LED short occurs on the LED string Cx. By such detection mechanism, the incapability of simultaneously performing the LED open and LED short detection on the LED strings in the prior can be improved.

Of course, the process 60 according to the embodiment of the present invention also includes the following steps: cutting off electrical connection between the loop control unit 53 and the LED string having the LED open when the LED open is detected on the LED strings C1~Cm; and cutting off electrical connection between the current driving unit 52 and the LED string having the LED short when the LED short is detected on the LED strings C1~Cm. The above operation is known by those skilled in the art, and is not narrated herein again.

To sum up, the present invention provides the method of simultaneously performing LED open and short detection for the LED device to prevent the LED short from being erroneously determined after occurrence of the LED open, which is a major problem in the prior art.

Those skilled in the art will readily observe that numerous modifications and alterations of the device and method may be made while retaining the teachings of the invention.

What is claimed is:

1. An LED device with simultaneous open and short detection function, the LED device comprising:

a plurality of LED strings, each LED string having a positive electrode and a negative electrode;

a voltage converter, coupled to the positive electrodes of the plurality of LED strings, for converting a first voltage to a second voltage according to a voltage control signal;

a current driving unit, coupled to the negative electrodes of the plurality of LED strings, for providing a plurality of driving currents to the plurality of LED strings;

a loop control unit, coupled to the plurality of LED strings and the voltage converter, for generating the voltage control signal according to negative electrode voltages of the plurality of LED strings;

an open detector, coupled to the plurality of LED strings and the loop control unit, for performing LED open detection on the plurality of LED strings according to the negative electrode voltages of the plurality of LED strings;

a short detector, coupled to the plurality of LED strings and the loop control unit, for performing LED short detection on the plurality of LED strings according to the negative electrode voltages of the plurality of LED strings; and a voltage detector, coupled to the open detector, the short detector and the voltage converter, for generating a reset signal to the short detector for restarting the LED short detection on the plurality of LED strings according to level variation of the second voltage when the open detector detects LED open occurring on the plurality of LED strings.

2. The LED device of claim 1, wherein the open detector detects the LED open occurring on the plurality of LED strings according to whether the negative electrode voltages of the plurality of LED strings are lower than a first threshold value.

3. The LED device of claim 1, wherein the short detector detects LED short occurring on the plurality of LED strings according to whether the negative electrode voltages of the LED strings are higher than a second threshold value.

4. The LED device of claim 1, wherein the voltage detector generates and sends the reset signal to the short detector for restarting the LED short detection on the plurality of LED strings when the open detector detects the LED open occurring on the plurality of LED strings and the second voltage is greater than a third threshold value.

5. The LED device of claim 1, wherein the loop control unit further comprises:

a voltage selector, coupled to the plurality of LED strings, for selecting a lowest voltage of the negative electrode voltages of the plurality of LED strings as a feedback voltage;

an error amplifier, coupled to the voltage selector and a reference voltage, for generating an error voltage signal according to a voltage difference between the feedback voltage and the reference voltage; and a conversion controller, coupled to the error amplifier and the voltage converter, for generating the voltage control signal according to the error voltage signal.

6. The LED device of claim 1, wherein the open detector cuts off electrical connection between the loop control unit and the LED string having the LED open when the LED open is detected on the plurality of LED strings.

7. The LED device of claim 1, wherein the short detector cuts off electrical connection between the current driving unit and the LED string having the LED short when the LED short is detected on the plurality of LED strings.

8. A method of simultaneously detecting open and short for an LED device, the LED device comprising a plurality of LED strings and a voltage converter, each LED string of the plurality of LED strings having a positive electrode and a negative electrode, the voltage converter, coupled to the positive electrodes of the plurality of LED strings, being utilized for converting a first voltage to a second voltage, the method comprising:

performing LED open and LED short detection on the plurality of LED strings according to negative electrode voltages of the plurality of LED strings; and restarting the LED short detection on the plurality of LED strings according to level variation of the second voltage when LED open is detected on the plurality of LED strings.

9. The method of claim 8, wherein the step of performing the LED open detection on the plurality of LED strings comprises:

detecting the LED open occurring on the plurality of LED strings according to whether the negative electrode voltages of the plurality of LED strings are lower than a first threshold value.

10. The method of claim 8, wherein the steps of performing the LED short detection on the plurality of LED strings comprises:

detecting the LED short occurring on the plurality of LED strings according to whether the negative electrode voltages of the plurality of LED strings are higher than a second threshold value.

11. The method of claim 8, wherein the steps of restarting the LED short detection on the plurality of LED strings according to the level variation of the second voltage when the LED open is detected on the plurality of LED strings comprises:

restarting the LED short detection on the plurality of LED strings when the LED open is detected on the plurality of LED strings and the second voltage is higher than a third threshold value.

12. The method of claim 8, wherein the LED device further comprises a loop control unit, coupled between the plurality of LED strings and the voltage converter, for controlling voltage conversion of the voltage converter according to the negative electrode voltages of the plurality of LED strings, and the method further comprises:

cutting off electrical connection between the loop control unit and the LED string having the LED open when the LED open is detected on the plurality of LED strings.

13. The method of claim 8, wherein the LED device further comprises a current driving unit, coupled to the negative electrodes of the plurality of LED strings, for providing a plurality of driving currents to the plurality of LED strings, and the method further comprises:

cutting off electrical connection between the current driving unit and the LED strings having the LED short when LED short is detected on the plurality of LED strings.

* * * * *